US007413412B2

(12) United States Patent
Govyandinov et al.

(10) Patent No.: US 7,413,412 B2
(45) Date of Patent: Aug. 19, 2008

(54) VACUUM MICROPUMP AND GAUGE

(75) Inventors: Alexander Govyandinov, Corvallis, OR (US); Sriram Ramamoorthi, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 671 days.

(21) Appl. No.: 10/878,262

(22) Filed: Jun. 28, 2004

(65) Prior Publication Data

US 2005/0287012 A1 Dec. 29, 2005

(51) Int. Cl.
*F04B 37/02* (2006.01)
*H02K 44/00* (2006.01)

(52) U.S. Cl. ..... 417/48; 417/50

(58) Field of Classification Search ..... 417/48, 417/50

See application file for complete search history.

(56) References Cited

U.S. PATENT DOCUMENTS 3,596,123 A * 7/1971 Levin ..... 313/7
4,460,317 A 7/1984 Kern et al.
4,594,054 A 6/1986 Ishimaru et al.
4,631,002 A 12/1986 Pierini
5,655,886 A * 8/1997 Alderson ..... 417/49
5,980,212 A * 11/1999 Shen et al. ..... 417/49
6,264,433 B1 7/2001 Spagnol

OTHER PUBLICATIONS

"Miniature Sputter-Ion Pump Design Considerations" by S.L. Rutherford; 1999 NASA/JPL Miniature Vacuum Pumps Workshop, Jul. 20-21, 1999.

* cited by examiner

*Primary Examiner*—Charles G Freay

(57) ABSTRACT

A vacuum micropump for use in a sealed package includes at least one pumping cell and a magnetic field proximate to the pumping cell. The pumping cell has at least one anode, at least one dielectric in contact with the at least one anode, at least one titanium cathode in contact with the dielectric and an electric field between the at least one anode and the at least one cathode. The dielectric defines a space between the at least one anode and the at least one cathode. The vacuum micropump may be used to gauge pressure within the sealed package. An appropriate method of use is also provided.

28 Claims, 6 Drawing Sheets

THIRD ANGLE PROJECTION

THIRD ANGLE PROJECTION

VACUUM MICROPUMP AND GAUGE

BACKGROUND

In micro-electromechanical systems (MEMS) (e.g., atomic resolution storage devices, vacuum microelectronic devices, miniature x-ray sources, and other such), it is desirable to hermetically encapsulate devices within a near vacuum. Micro-optical electromechanical systems (MOEMS) require a vacuum for reliable operation. Typically, the operational life of a device is reduced when the vacuum is not maintained. Thus, it is desirable to maintain the vacuum within the device.

Semiconductor, other electronic and mechanic devices, such as MEMS, MOEMS and other similar devices, are often hermetically encapsulated as a package in such a way as to provide a near vacuum within the device. Although these packages are hermetically sealed, outgassing (release of gasses from a solid as a result of heating or reduced pressure) from a number of sources within the package releases moisture and gasses that decrease the operational life of the encapsulated devices by reducing the internal vacuum. Encapsulated packages also allow gasses to diffuse through their encapsulation materials and/or may have micro-leaks that, over time, allow gases to enter the encapsulation.

One solution to this problem is to include a getter material that absorbs and traps any outgased substances. For example, MOEMS devices often include getters that selectively attract undesirable substances within the hermetic encapsulation, thereby prolonging the operational life of the device.

Evaporated getters and activated getters are typically based on barium (Ba), titanium (Ti), zirconium (Zr), vanadium (V), iron (Fe) and aluminum (Al) alloys that react with gas molecules to trap them. Typically, such getters require high outgassing and activating temperatures. More specifically, a getter may require heating (typically=400° C.) using a certain heating method for a certain period of time under a near vacuum to achieve optimum activation. Evaporated deters are typically used due to their simplicity. They are sputtered after sealing and generally require a lot of mirror surfaces for the gas absorption. In addition, they may leak out, diffuse into the device or in other ways fail to perform as expected. For small package environments, especially micro-package environments, evaporated getters are usually inappropriate. Activated getters are typically must valuable when used for small vacuum shells.

Typically, the vacuum must be maintained during the cooling off period of the getter, prior to sealing the encapsulation. Additionally, some getter types have a certain operating temperature, and may thus require additional heating during operation in order to be affective. This temperature activation, particularly during operation, causes additional stress to the encapsulated device, and is inappropriate for small volumes desired to be at a near vacuum. Further, once activated, getter materials have a limited life, absorbing only limited amounts of gasses chemically active gasses such as $O_2$, $H_2O$, CO, $CO_2$, and etc.

In one example, a micro-resonator device requires a controlled, low-pressure or vacuum environment for high Q factor operation (Q factor is a measure of the "quality" of a resonant system and is defined as the resonant frequency divided by the bandwidth). A typical mass for a very high frequency (VHF) micro-resonator is approximately $10^{-13}$ kilograms, and thus small amounts of mass-loading (e.g., from gas molecules) cause significant resonance frequency shifts and induce phase noise. It is thus desirable to maintain and measure gas pressure within the micro-resonator's environment to ensure correct operation. There is currently no method of measuring pressure in volumes less than 0.5 $cm^3$.

Ion pumps are typically used to create a near vacuum and operate by ionizing gas within a magnetically confined, cold cathode discharge. Electrons, produced by the cold cathode discharge, are entrapped within a magnetic field and collide with gas molecules to form ions. Typically, the cathode of an ion pump is comprised of titanium. These ions are accelerated towards a titanium cathode, where they sputter titanium. The sputtered titanium chemically reacts with, and traps, active gasses, and the sputtered titanium buries other noble gasses on impact with the pump walls.

For example, an ion pump may be used to create a vacuum during getter activation prior to device encapsulation, where the entire encapsulation process is being performed within the vacuum.

To increase the longevity and operational life expectancy of a vacuum-dependent device, it is desirable to provide continued evacuation after original encapsulation. In addition, a measurement of internal pressure may be used to predict operational performance.

As stated above, although the encapsulated environment is initially created with a vacuum, the vacuum typically degrades with time. It is generally impractical to re-evacuate the package environment by performing a re-encapsulation or by connecting the package to an external vacuum pump.

Hence, there is a need for a vacuum micropump and gauge that overcomes one or more of the drawbacks identified above.

SUMMARY OF THE INVENTION

The present disclosure advances the art and overcomes problems articulated above by providing a vacuum micropump and gauge.

In particular, and by way of example only, according to an embodiment of the present invention, this invention provides a vacuum micropump for use within a sealed vacuum package; including: at least one pumping cell within the sealed package; each pumping cell including: at least one anode; at least one dielectric in contact with the at least one anode; at least one cathode in contact with the dielectric, the dielectric further defining a space between the at least one anode and the at least one cathode; and an electric field between the at least one anode and the at least one cathode; and a magnetic field proximate to the pumping cell.

DETAILED DESCRIPTION OF THE FIGURES

Before proceeding with the detailed description, it is to be appreciated that the present teaching is by way of example, not limitation. The concepts herein are not limited to use with a specific type of vacuum micropump and/or gauge. Thus, although the instrumentalities described herein are for the convenience of explanation, shown and described with respect to exemplary embodiments, it will be appreciated that the principals herein may be equally applied in other types of vacuum micropumps and gauge devices.

To increase the life expectancy of micro-electromechanical system (MEMS) and micro-optical electromechanical system (MOEMS) devices it is highly desirable to maintain a vacuum within the encapsulated environment of these devices. An ideal solution is to include a vacuum micropump within the encapsulated environment. The following description provides examples for including a vacuum micropump and gauge within an encapsulated environment of ultra small volume for maintaining a vacuum and measuring pressure within the ultra small volume. The vacuum micropump operates on similar principals to sputter-ion pumps, and traps gas molecules to reduce pressure within the small volume. However, the proposed vacuum micropump described herein has a substantially different architecture as compared to conventional sputter-ion pumps of the prior art. For example, the ultra small volume may have a volume in the range 0.1 to 500 cubic millimeters. In addition the vacuum micropump is not provided with it's own housing, rather it is a substantially open device placed within the sealed package, as is more fully described below.

Figure 1:
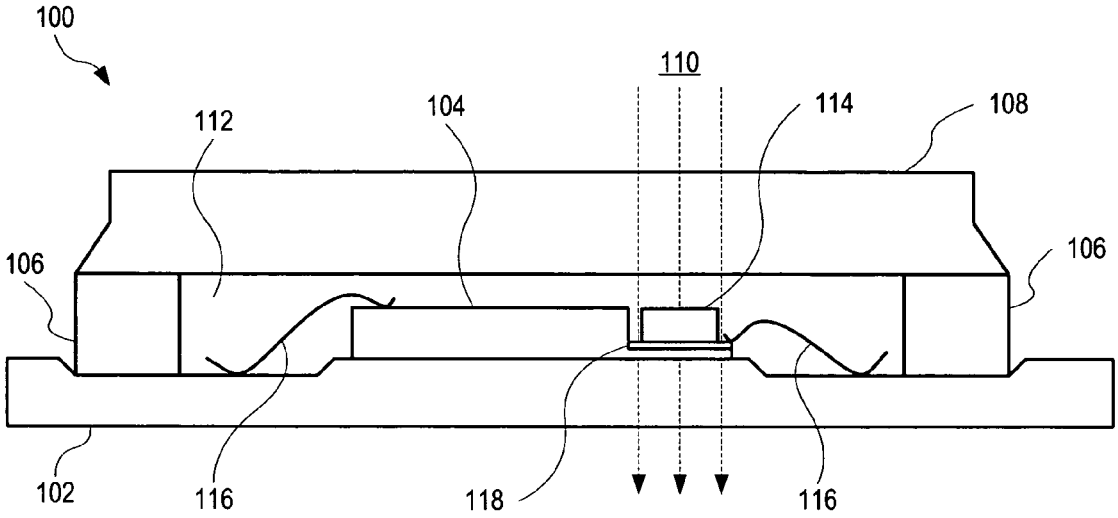
FIG. 1 shows a cross section through one exemplary micro-electromechanical system (MEMS) package that utilizes a vacuum micropump to maintain a vacuum within an encapsulated environment having an ultra small volume.

FIG. 1 shows a cross section through one exemplary micro-electromechanical system (MEMS) package, hereinafter referred to as a sealed package 100 that utilizes a vacuum micropump 114 to maintain a vacuum within encapsulated environment 112 having an ultra small volume. The package 100 has a ceramic base 102, a fabricated device 104 mounted on ceramic base 102, a seal 106 formed on ceramic base 102 to surround device 104 and a cap 108 that mates with seal 106 to encapsulate device 104 and form controlled internal environment 112. Fabricated device 104 may represent MEMS and MOEMS devices that require encapsulation in a vacuum environment, for example. Electrical connections are made to device 104 and vacuum micropump 114 using wires 116, for example.

Figure 2:
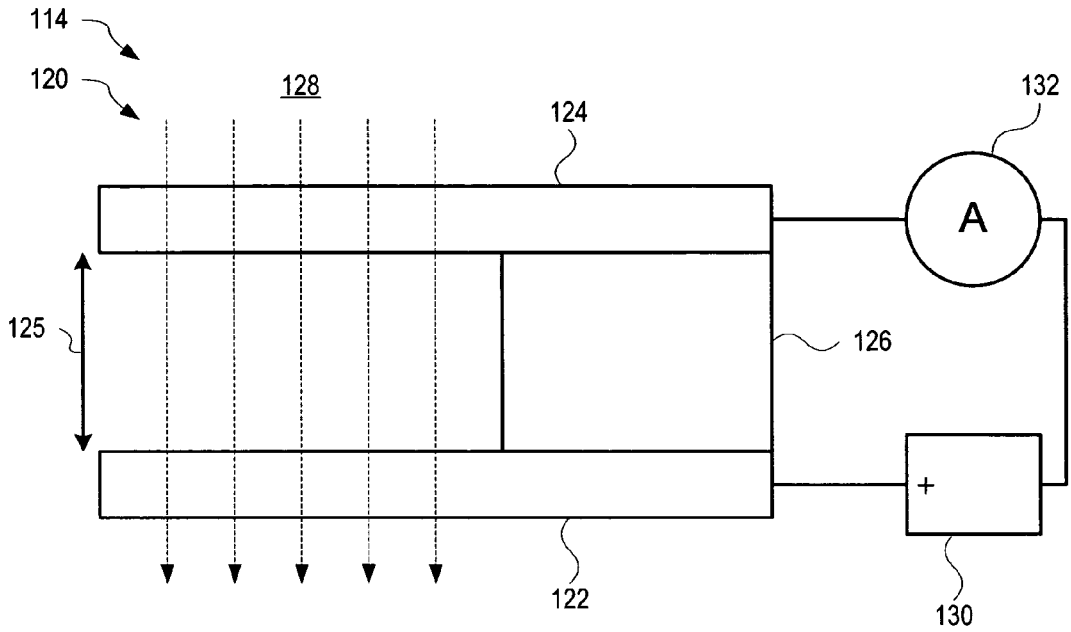
FIG. 2 is a schematic diagram illustrating one exemplary pumping cell with a power supply and an ammeter.
Figure 3:
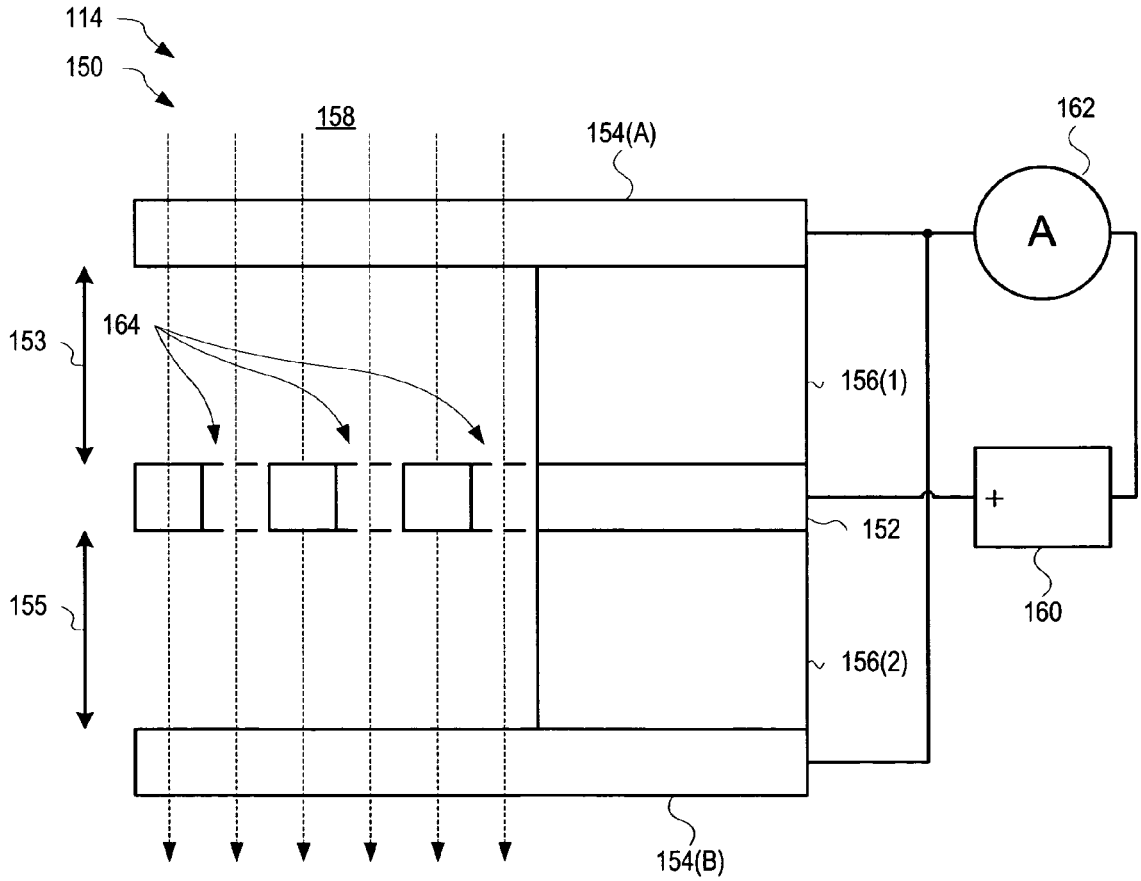
FIG. 3 shows one exemplary pumping cell with a power supply and an ammeter.
Figure 5:
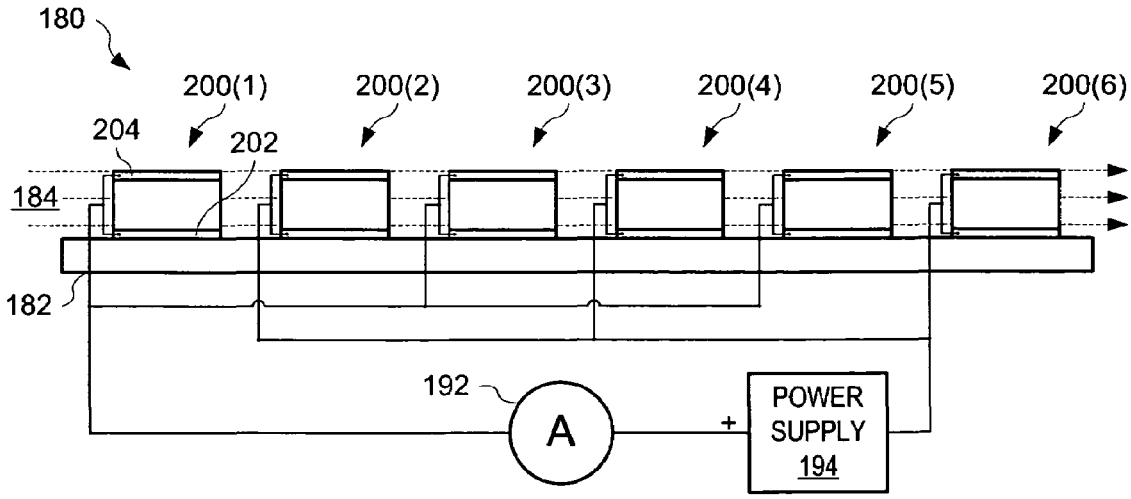
FIG. 5 shows one exemplary embodiment of a linear vacuum micropump with a linear array of six identically shaped micro stacks that are micro-fabricated upon a substrate.

A magnetic field 110 is formed and applied proximate to the pumping cell 120 (see FIG. 2) through vacuum micropump 114. As is further described below, FIGS. 2, 3 and 5 present various configurations of pumping cells (120, 150 and 180) which may be incorporated within vacuum micropump 114 or linear vacuum micropump 180. Magnetic field 110 may be applied from an external source, not shown, or generated internally within the package 100. Magnetic field 110 may have a magnetic field strength greater than 1 Tesla and may be generated by a) very strong permanent magnets, b) electromagnetic coils or c) superconductive magnets, for example.

Vacuum micropump 114 may be formed on a non-conductive substrate 118 (or Si substrate with relatively thick oxide—typically 0.1-5 μm) of device 104. Alternatively, vacuum nicropump 114 may be formed on a separate substrate within encapsulated environment 112. Vacuum micropump 114 may include a simple single pumping cell construct, as shown in pumping cells 120 and 150 of FIGS. 2 and 3, respectively, or may include a plurality of micro stacks 200 in a linear array, as shown in linear vacuum micropump 180, FIG. 5.

In one embodiment, vacuum micropump 114 operates, preferably, continually to maintain a vacuum within environment 112. In another embodiment, vacuum micropump 114 operates periodically to maintain a vacuum within environment 112. In another embodiment, vacuum micropump 114 operates periodically to measure and maintain a vacuum within environment 112. Such periodic operation may be employed when the operation of device 104 is intermittent, for example.

FIG. 2 is a schematic diagram illustrating one exemplary pumping cell 120 with a power supply 130 and an ammeter 132. Pumping cell 120 includes an anode 122 and a cathode 124 separated by a dielectric 126. Anode 122, cathode 124 and dielectric 126 are micro-fabricated, for example. Anode 122 is metallic and is electrically coupled to a positive voltage on power supply 130. Cathode 124 is made of material such as titanium (Ti), tantalum (Ta), vanadium (V), molybdenum (Mo), and/or other metals and is disposed substantially parallel to, aligned with and spaced apart from, anode 122 by dielectric 126. Pumping cell 120 is suitable for use as vacuum micropump 114, FIG. 1, for example.

The distance between anode 122 and cathode 124, shown as spacing 125, may be between about 1 μm and 50 μm. Cathode 124 is connected to a negative terminal of power supply 130 through ammeter 132. Dielectric 126 insulates anode 122 from cathode 124 and is selected to reduce leakage current between anode 122 and cathode 124. A magnetic field 128 is applied substantially transverse to the plane of anode 122 and the plane of cathode 124, as shown in FIG. 2. In at least one embodiment, magnetic field 128 is substantially perpendicular to the plane of anode 122 and the plane of cathode 124.

Power supply 130 generates a voltage difference between anode 122 and cathode 124, such that an intense electric field is generated between anode 122 and cathode 124. The intense electric field causes a breakdown of gas present between anode 122 and cathode 124 and results in a glow discharge (known as the Penning discharge) between anode 122 and cathode 124. In one embodiment, power supply 130 supplies a voltage between 100V and 6000V. In another embodiment, power supply 130 supplies a voltage between 100V and 400V per μm of spacing 125. In another embodiment, power supply 130 supplies a voltage of ~1 kV per μm of spacing 125.

Figure 14:
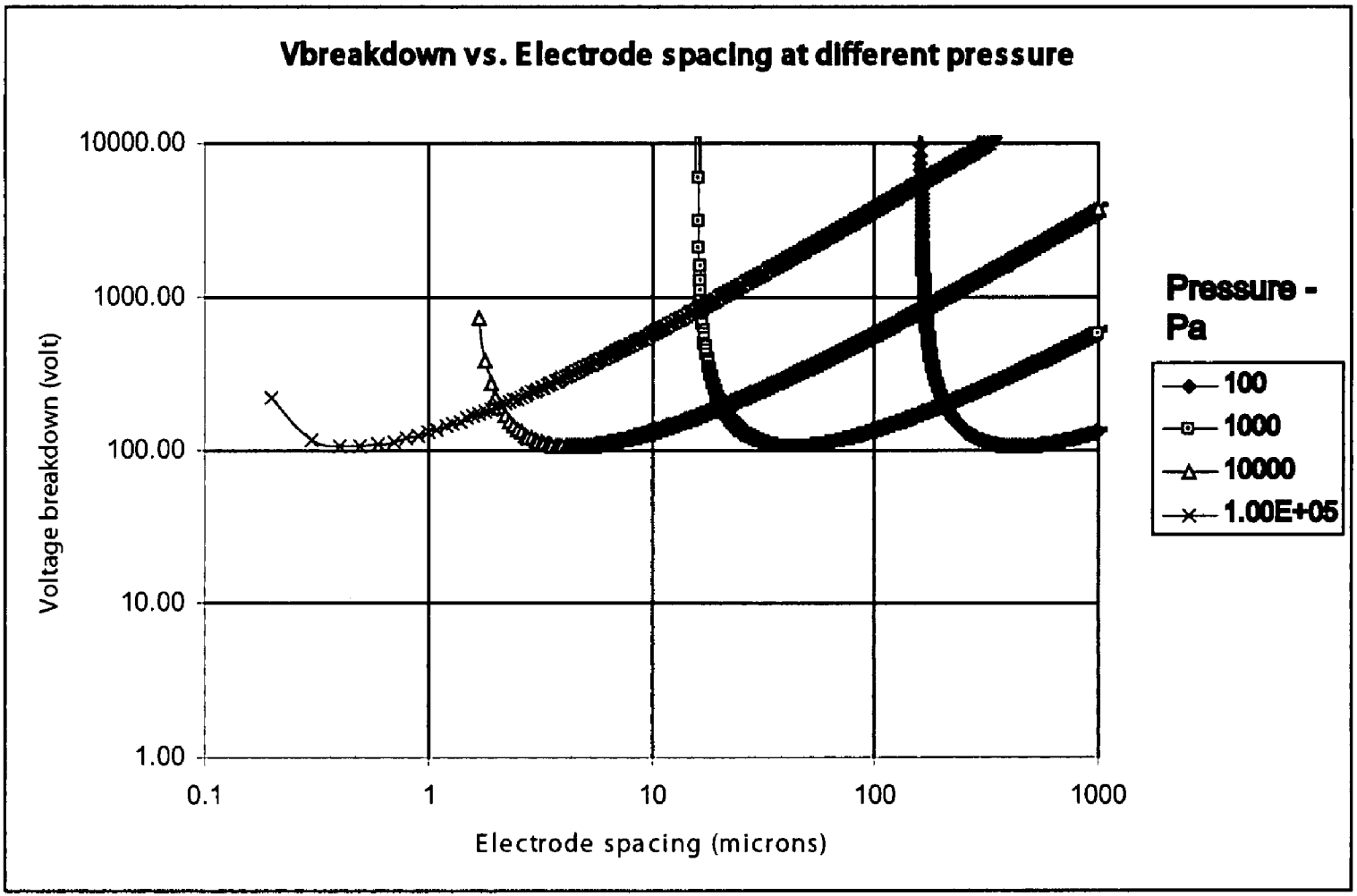
FIG. 14 presents typical Paschen's curves illustrating the relationship between voltage breakdown and electrode spacing at various pressures

FIG. 14 presents typical Paschen's curves illustrating the relationship between voltage breakdown and electrode spacing at various pressures. From FIG. 14 it is evident that to ionize gas molecules the necessary spacing between anodes and cathodes increases as the pressure decreases. This relationship results because the mean free path of an electron increases with a drop in pressure. To increase the path of the electron and so increase the chance of a collision between the electron and a gas molecule, a magnetic field (such as magnetic field 128) is applied.

Magnetic field 128 increases the trajectory of electrons created by the Penning discharge into a spiral path around anode 122, such that the probability of electron collision with, and ionization of, residual gas molecules is enhanced. In other words, the magnetic field 128 promotes electrons to ionize the residual gas molecules within the package. In one example, magnetic field 128 has a strength of about 1 Tesla. A high magnetic field strength is preferred due to the small distance (1-50 μm) between anode 122 and cathode 124. Ions formed by this process are accelerated towards cathode 124 whereupon they:

a) are buried, and/or b) are neutralized, and/or c) cause sputtering of Ti from cathode 124, which chemically combines with gas molecules and/or is deposited on adjacent surfaces surrounding pumping cell 120, and/or d) combine chemically with exposed Ti of cathode 124.

Ammeter 132 measures an ion current flowing as a result of the ionization process between anode 122 and cathode 124. As pressure decreases, the ion current reduces. Therefore, pressure advantageously may be gauged by measuring current with ammeter 132. The relationship between pressure and ion current is shown by the equation:

$$\text{IonCurrent}=k*\text{Pressure}*\text{Pump Speed}$$

where Pump Speed is defined in liters per second and is based on the physical size of vacuum micropump 114 and strength of magnetic field 128, and k is a constant based on other operating parameters of vacuum micropump 114. For example, a typical ion current for a large scale sputter-ion pump at a pressure of $10^{-6}$ to $10^{-8}$ torr is in the range 10-500 μA and k is between 0.05 and 0.2. Vacuum micropump 114 is considerably different from the large scale sputter-ion pump, and has smaller ion current and may have different values of k. For example, a 1 cubic millimeter volume at $10^{-6}$ torr contains approximately $10^{7}$ atoms of residual gasses and expected ion current is approximately $10^{-12}$ A. Thus, if power supply 130 provides a voltage of 1 kV, total power consumption is approximately 1 nW.

FIG. 3 shows an alternative exemplary pumping cell 150 with a power supply 160 and an ammeter 162. Pumping cell 150 has an anode 152, spaced between two cathodes 154(A) and 154(B) by two dielectrics 156(1) and 156(2). Anode 152, cathodes 154 and dielectrics 156 are micro fabricated, for example. Anode 152 is connected to a positive voltage of power supply 160, and cathodes 154 are connected to a negative voltage of power supply 160 such that an electric field is created between anode 152 and cathodes 154. Pumping cell 150 is suitable for use as vacuum micropump 114, FIG. 1, for example.

The distance between anode 152 and cathode 154(A), shown as spacing 153, may be between about 1 μm and 50 μm. Similarly, the distance between anode 152 and cathode 154 (B), shown as spacing 155, may be between about 1 μm and 50 μm. In at least one embodiment the spacing 153 is substantially equal to the spacing 155.

As shown, cathodes 154(A) and 154(B) are connected through ammeter 162 to the negative voltage of power supply 160. The electric field causes breakdown of gases between anode 152 and cathodes 154 resulting in a Penning discharge. A magnetic field 158 is applied substantially transverse to anode 152 and cathodes 154(A) and 154(B) to force electrons into a spiral path between Anode 152 and cathodes 154. Anode 152 may contain holes 164, apertures or other transverse passageways to improve the movement of gas and improve the efficiency of pumping cell 150.

It will be appreciated that in FIGS. 2 and 3, no external structure is shown to enclose vacuum micropump 114, more specifically, pumping cells 120, 150 separate and apart from the outer structure of the package 100. A traditional ion pump is enclosed within its own housing or structure and is attached to another structure with a volume to be evacuated. In the case of the vacuum micropumps herein disclosed, the vacuum micropumps are entirely disposed within the enclosed package 100. In other words, structure enclosing the package 100 and defining it's ultra small volume additionally encloses the vacuum micropump. In other words, the vacuum micropumps herein disclosed are evacuating the packages 100 in which the vacuum micropumps themselves are disposed. Moreover, the vacuum micropump operates to replace a getter material within an encapsulated package 100.

It is understood and appreciated that the figures provided are for ease of discussion and that pumping cell 120 and pumping cell 150 may have alternate anode and cathode configurations without departing from the scope hereof.

Figure 4:
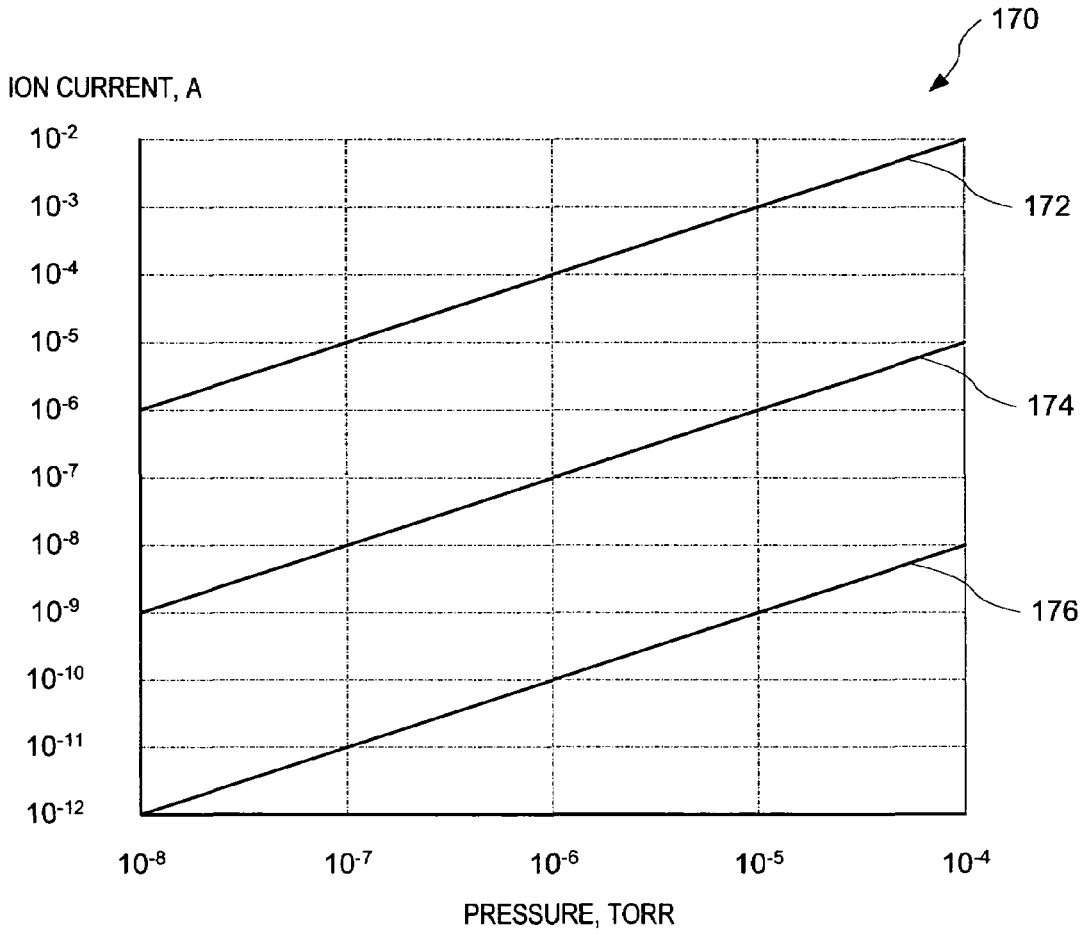
FIG. 4 is a graph illustrating relationships between ion current and pressure.

As stated above, internal pressure may be inferred by the measurement of ion current. FIG. 4 provides a graph 170 to help illustrate this relationship. More specifically, in graph 170, line 172 shows ion current reducing as pressure decreases for a sputter-ion pump (e.g., a conventional large sputter-ion pump) with a pumping speed of 1000 liters per second. Line 174 shows ion current reducing as pressure decreases for a sputter-ion pump (e.g., a conventional small sputter-ion pump) with a pumping speed of 1 liter per second. Line 176 shows ion current reducing as pressure decreases for a vacuum micropump (e.g., vacuum micropump 114, FIG. 1) with a pumping speed of 1 milliliter per second. As appreciated, for a given pump, the relationship between pressure and ion current is linear, and thus allows pressure to be determined by measuring ion current.

FIG. 5 shows one exemplary embodiment of a linear vacuum micropump 180 with a linear array of six identically shaped micro stacks 200(1), 200(2), 200(3), 200(4), 200(5) and 200(6) that are micro-fabricated upon a substrate 182. Substrate 182 is, for example, a non-conductive substrate and may represent substrate 118 shown in FIG. 1. As in FIGS. 2 and 3 no external structure is shown to enclose linear vacuum micropump 180 separate and apart from the outer structure of the package 100. Micro stacks 200 are shown in further detail in FIGS. 6 and 7. Linear vacuum micropump 180 may also utilize micro stack 220 of FIGS. 8 and 9, micro stack 250 of FIG. 10 and micro stack 280 of FIG. 11 in place of micro stacks 200 to increase surface area and thereby increase pumping speed and efficiency of linear vacuum micropump 180. The surface area of linear vacuum micropump 180 determines the number of electrons produced by Penning discharge. The greater the number of electrons, the greater the probability of electron collisions with residual gas molecules, thereby increasing the performance of linear vacuum micropump 180.

With respect to FIG. 5, micro stacks 200(1), 200(3) and 200(5) form anodes while micro stacks 200(2), 200(4) and 200(6) form cathodes for linear vacuum micropump 180. First and second plates 202, 204 (see FIGS. 6 and 7) of anode micro stacks 200(1), 200(3) and 200(5) may be constructed of titanium (Ti), tantalum (Ta), vanadium (V), molybdenum (Mo), and/or other metals. Plates of anode micro stacks 200

(1), 200(3) and 200(5) are connected to an ammeter 192 that is in turn connected to a positive voltage of a power supply 194.

First and second plates 202, 204 (see FIGS. 6 and 7) of cathode micro stacks 200(2), 200(4) and 200(6) may be constructed of titanium (Ti), tantalum (Ta), molybdenum (Mo) and/or other similar metals. First and second plates 202, 204 of micro stacks 200(2), 200(4) and 200(6) are connected to a negative voltage of power supply 194. Material from anode micro stacks 200(1), 200(3) and 200(5) is not sputtered during operation. Material from cathode micro stacks 200(2), 200(4) and 200(6) is sputtered during operation.

Substrate 182 electrically isolates micro stacks 200 from each other, and thereby isolates anode micro stacks 200(1), 200(3) and 200(5) from cathode micro stacks 200(2), 200(4) and 200(6). Power supply 194 produces a voltage such that a Penning discharge is created between: micro stack 200(1) and micro stack 200(2); micro stack 200(2) and micro stack 200(3); micro stack 200(3) and micro stack 200(4); micro stack 200(4) and micro stack 200(5), and micro stack 200(5) and micro stack 200(6).

A magnetic field 184 is formed substantially parallel to substrate 182 and/or the electric field and thus parallel to the linear array of micro stacks 200. Magnetic field 184 is of a lesser strength as compared to magnetic fields 128 and 158 of pumping cell 120, FIG. 2, and pumping cell 150, FIG. 3, respectively, since spacing between anode micro stacks 200(1), 200(3) and 200(5) and cathodes micro stacks 200(2), 200(4) and 200(6) may be greater than spacing 125 between anode 122 and cathode 124 of pumping cell 120, and spacings 153 and 155 between anode 152 and cathodes 154 of pumping cell 150. Although magnetic field 184 has less strength and electron trajectories are less curved, increased spacing between anode micro stacks 200(1), 200(3) and 200(5) and cathode micro stacks 200(2), 200(4) and 200(6) of linear vacuum micropump 180 still results in efficient ionization of residual gas molecules.

In one embodiment, linear vacuum micropump 180 may initially operate with magnetic field 184 to achieve a required pressure, and then strength of magnetic field 184 may be reduced or removed. Although efficiency of linear vacuum micropump 180 is reduced without magnetic field 184, linear vacuum micropump 180 still operates to maintain the reduced pressure. In one example, magnetic field 184 may be created by electromagnetic coils that are deactivated to conserve energy once the required pressure is obtained. Generally speaking, operation with an intermittent magnetic field is less desirable than continuous mode operation. To permit an intermittent magnetic field generally requires large cathode-anode spacing and lower vacuums. In at least one embodiment, magnetic field 184 is continuously provided during operation.

In another embodiment, dielectric ribs or fins (not shown) may be added to substrate 182 to increase the electrical isolation of substrate 182 by reducing surface leakage and breakdown. The addition of dielectric ribs or fins allows power supply 194 to operate linear vacuum micropump 180 with increased voltage, resulting in greater efficiency.

Figure 6:
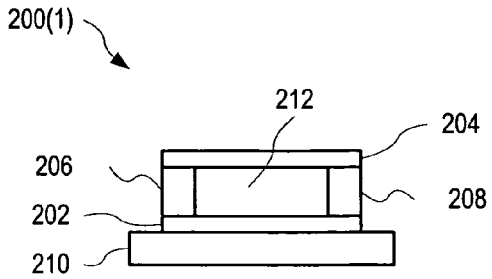
FIGS. 6 and 7 show two elevations of the micro stack of FIG. 5, which has two plates in the form of an arch.
Figure 7:
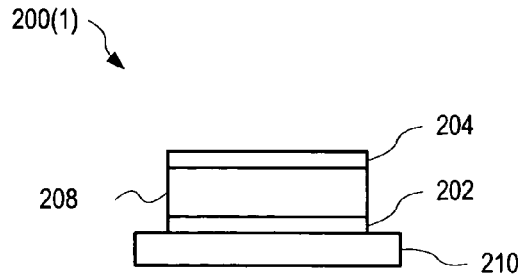

FIGS. 6 and 7 show two elevations of micro stack 200(1) shown in FIG. 5, which has two plates in the form of an arch. More specifically, FIG. 6 is a cross sectional front view of micro stack 200(1), and may represent any of micro stacks 200(1)~200(6). Shown is a first plate 202 disposed upon a substrate 210, and a second plate 204 disposed substantially parallel to, aligned with and separated from first plate 202 by spacers 206 and 208. Collectively, first plate 202, second plate 204 and spacers 206 and 208 define open space 212 within micro stack 200(1).

FIG. 7 shows a side elevation of micro stack 200(1) shown in FIG. 6, illustrating first plate 202 disposed upon substrate 210 and second plate 204 substantially parallel to, aligned with and separated from first plate 202 by spacer 208. Space 212 and spacer 206 are concealed from view as they are directly in line with spacer 208. In one embodiment spacers 206 and 208 are dielectrics and electrically insulate first plate 202 from second plate 204. In another embodiment, spacers 206 and 208 conduct electricity and thereby electrically connect first and second plates 202 and 204 together.

Figure 8:
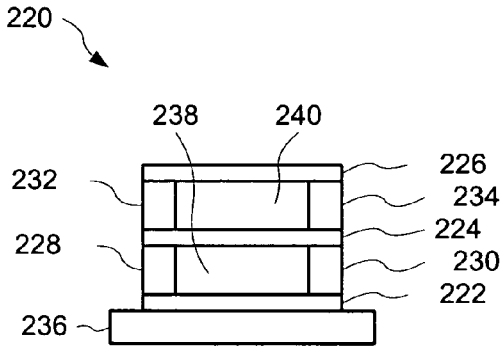
FIG. 8 and FIG. 9 show two elevations of one exemplary micro stack that has three plates in a stacked arch form.
Figure 9:
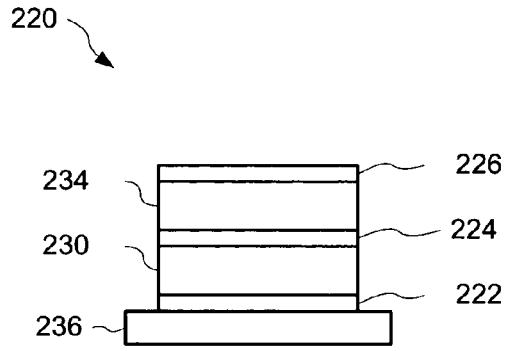

FIG. 8 and FIG. 9 show two elevations of an exemplary micro stack 220 that has three plates in a stacked arch form. More specifically, FIG. 8 is a cross sectional front view of micro stack 220 with a first plate 222 disposed upon a substrate 236, a second plate 224 disposed substantially parallel to, aligned with and separated from first plate 222 by spacers 228 and 230, and a third plate 226 disposed substantially parallel to, aligned with and separated from second plate 224 by spacers 232 and 234. Collectively, first plate 222, second plate 224 and spacers 228 and 230 form a first open space 238; and second plate 224, third plate 226 and spacers 232 and 234 form a second open space 240. Substrate 236 may represent substrate 182, FIG. 5, for example.

FIG. 9 shows a side elevation of micro stack 220 shown in FIG. 8, illustrating first plate 222 disposed upon substrate 236, second plate 224 substantially parallel to, aligned with and separated from first plate 222 by spacer 230, and third plate 226 substantially parallel to, aligned with and separated from second plate 224 by spacer 234. Space 238 and spacer 228 are concealed from view as they are directly in line with spacer 230. Space 240 and spacer 232 are concealed from view as they are directly in line with spacer 234.

Micro stack 220 has an increased surface area as compared to a surface area of micro stack 200(1), shown in FIGS. 6 and 7, and therefore micro stack 220 has an improved pumping speed. For example, the surface area of micro stack 220 determines the number of electrons produced by Penning discharge. The greater the number of electrons, the greater the probability of these electrons colliding with residual gas molecules, which increases the performance of micro stack 220. In one embodiment, spacers 228, 230, 232 and 234 are dielectrics and electrically insulate plates 222, 224 and 226 from each other. In another embodiment, spacers 228, 230, 232 and 234 conduct electricity and thereby electrically connect plates 222, 224 and 226 together.

Figure 10:
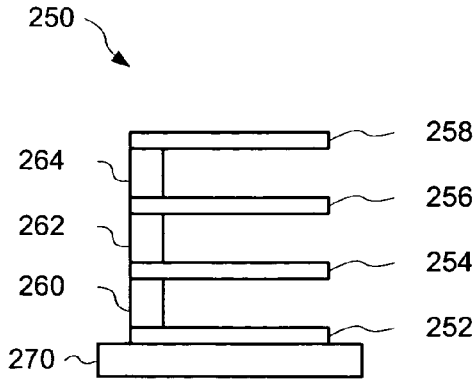
FIG. 10 shows a front elevation of one exemplary micro stack that has four plates that form a winged or finned structure.

FIG. 10 shows a front elevation of one exemplary micro stack 250 with four plates that form a winged or finned structure. Micro stack 250 has a first plate 252 disposed upon a substrate 270. A second plate 254 is disposed substantially parallel to, aligned with and separated from first plate 252 by a spacer 260 located at one side of first plate 252. A third plate 256 is disposed substantially parallel to, aligned with and separated from second plate 254 by a spacer 262 located at one side of second plate 254. A fourth plate 258 is disposed substantially parallel to, aligned with and separated from third plate 256 by a spacer 264 located at one side of third plate 256. Collectively, first plate 252, second plate 254, third plate 256 fourth plate 258 and spacers 260, 262 and 264 form a 'winged' or 'finned' structure, as shown. In one embodiment spacers 260, 262 and 264 are dielectrics and electrically insulate plates 252, 254, 256 and 258 from each other. In another embodiment, spacers 260, 262 and 264 conduct electricity and electrically connect plates 252, 254, 256 and 258 together. Substrate 270 may represent substrate 182, FIG. 5, for example.

Figure 11:
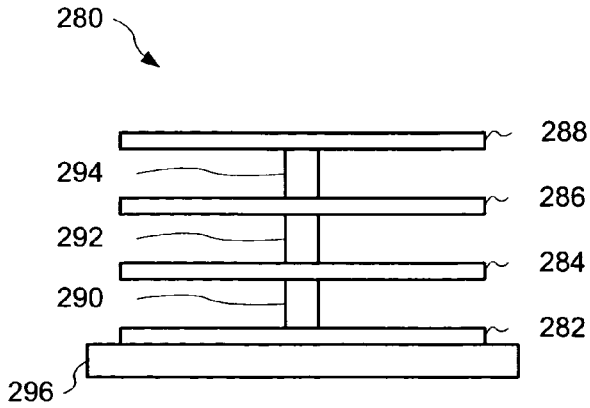
FIG. 11 shows a front elevation of one exemplary micro stack that has four plates that form a double winged or finned structure.

FIG. 11 shows a front elevation of one exemplary micro stack 280 that has four plates that form a double winged or finned structure. More particularly, micro stack 280 has a first plate 282 disposed upon a substrate 296. A second plate 284 is disposed substantially parallel to, aligned with and separated from first plate 282 by a spacer 290 that is centrally positioned. A third plate 286 is disposed substantially parallel to, aligned with and separated from second plate 284 by a spacer 292 that is centrally positioned. A fourth plate 288 is disposed substantially parallel to, aligned with and separated from, third plate 286 by a spacer 294 that is centrally positioned. Collectively, first plate 282, second plate 284, third plate 286, fourth plate 288 and spacers 290, 292 and 294 form a double winged or finned structure, as shown. In one embodiment spacers 290, 292 and 294 are dielectrics and electrically insulate plates 282, 284, 286 and 288 from each other. In another embodiment, spacers 290, 292 and 294 conduct electricity and electrically connect plates 282, 284, 286 and 288 together. Substrate 296 may represent substrate 182, FIG. 5, for example.

Figure 12:
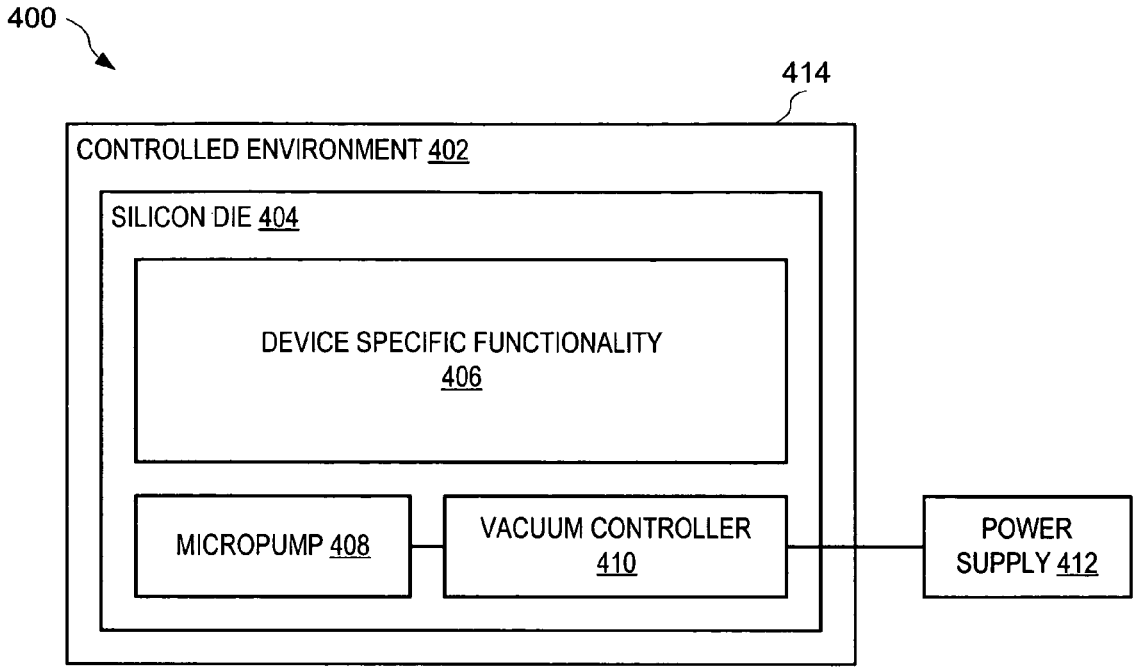
FIG. 12 shows one exemplary controlled environment that encapsulates a silicon die with device specific functionality, a vacuum micropump and a vacuum controller.

FIG. 12 is a block diagram illustrating an exemplary encapsulated package 400. In FIG. 12, a housing 414 encloses a controlled environment 402 that encapsulates a silicon die 404 with device-specific functionality 406, a vacuum micropump 408 and a vacuum controller 410. Device-specific functionality 406 may represent a MEMS or MOEMS device that requires a vacuum environment, for example. Vacuum micropump 408 and vacuum controller 410 advantageously measure and maintain a vacuum within controlled environment 402. Vacuum micropump 408 and vacuum controller 410 achieve such control through being disposed within controlled environment 402 of encapsulated package 400.

More specifically, vacuum micropump 408 is not disposed within a separate housing coupled to housing 414 of the encapsulated package 400. Housing 414 may be required to prevent the influx of unintended foreign gas or other matter into vacuum micropump 408 from the external environment. Vacuum micropump 408 is reliant upon housing 414 of encapsulating package 400.

In one example, an external power supply 412 provides power to vacuum controller 410 that operates vacuum micropump 408 and measures ion current of vacuum micropump 408 to determine pressure within controlled environment 402. Vacuum controller 410 may operate vacuum micropump 408 continually to measure and/or maintain the vacuum within controlled environment 402, or may periodically operate vacuum micropump 408 to measure and/or maintain the vacuum within controlled environment 402.

Figure 13:
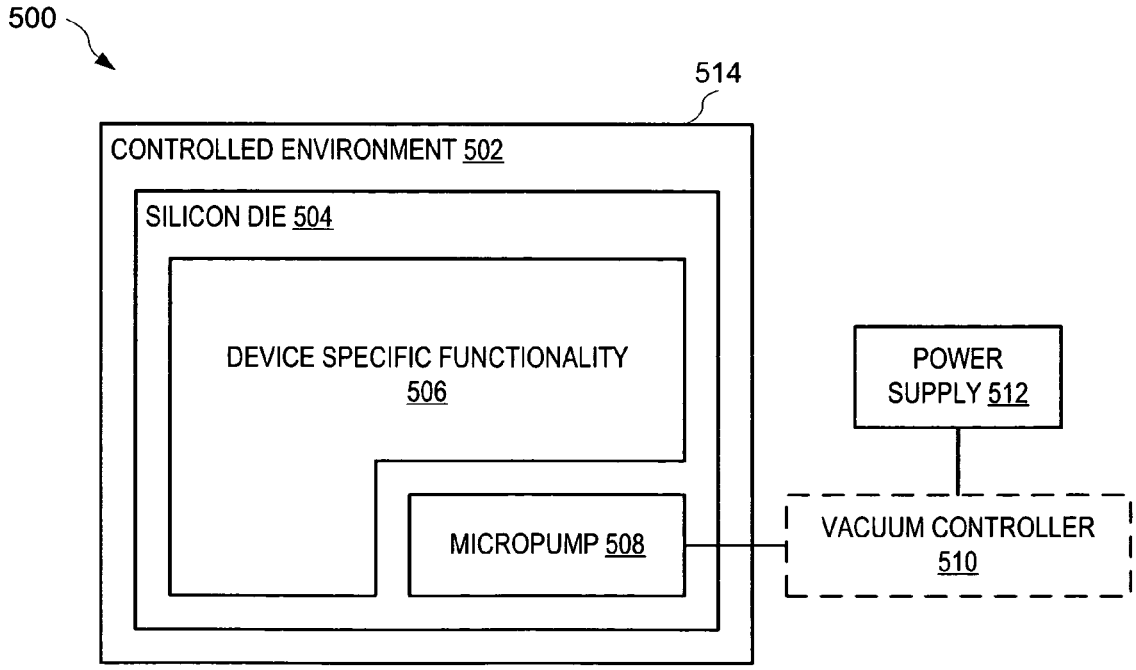
FIG. 13 shows one exemplary controlled environment that encapsulates a silicon die with device specific functionality and a vacuum micropump.

Similar to FIG. 12, FIG. 13 conceptually illustrates in block form yet another exemplary encapsulated package 500. In FIG. 13, a housing 514 encloses a controlled environment 502 that encapsulates a silicon die 504 with device-specific functionality 506 and a vacuum micropump 508. Device-specific functionality 506 may represent a MEMS or MOEMS device that requires a vacuum environment, for example. A power supply 512 connects to an optional vacuum controller 510, which in turn connects to vacuum micropump 508.

Vacuum controller 510, if included, may operate vacuum micropump 508 continually to measure and/or maintain the vacuum within controlled environment 502, or may periodically operate vacuum micropump 508 to measure and/or maintain the vacuum within controlled environment 502. If vacuum controller 510 is not included, power supply 512 connects to vacuum micropump 508, which operates continually to maintain the vacuum within controlled environment 502. As shown, vacuum micropump 508 is disposed within controlled environment 502 of encapsulated package 500.

As appreciated, vacuum micropump 114 and linear vacuum micropump 180 utilize approximately 1% of cathode mass to absorb gas molecules. Where a volume containing vacuum micropump 114 or linear vacuum micropump 180 is less than one cubic millimeter, this capacity is sufficient for long term operation.

Vacuum micropump 114 and linear vacuum micropump 180 may also be used in other small volume spaces that require a continual vacuum. Vacuum micropump 114 and linear vacuum micropump 180 may also be used in other small volume spaces for which pressure is to be measured. For example, vacuum micropump 114 or linear vacuum micropump 180 may be included within a micro-vacuum tube such as an x-ray micro tube, and other micro circuits requiring a vacuum. The shape and area of pumping cells (e.g., pumping cells 120 and 150) and micro stacks (e.g., micro stacks 200, 220, 250 and 280) may be selected to suit each application, and are not limited to the shapes illustrated in the examples above. Pumping speed is proportional to the area of each pumping cell 120, 150, and therefore size should be taken into account when designing each application.

Changes may be made in the above methods and systems without departing from the scope hereof. It should thus be noted that the matter contained in the above description or shown in the accompanying drawings should be interpreted as illustrative and not in a limiting sense. The following claims are intended to cover all generic and specific features described herein, as well as all statements of the scope of the present method and system, which, as a matter of language, might be said to fall therebetween.

What is claimed is:

1. A vacuum micropump for use within a sealed package enclosing at least one micro device; comprising:

at least one oven pumping cell within the sealed package and adjacent to the micro device; each pumping cell including:

at least one anode;

at least one dielectric in contact with the at least one anode;

at least one cathode in contact with the dielectric and opposite from and aligned to the anode, the dielectric further defining a space between the at least one anode and the at least one cathode; and an electric field between the at least one anode and the at least one cathode; and a magnetic field proximate to the pumping cell.

2. The vacuum micropump of claim 1, wherein the cathode comprises material selected from the group consisting of titanium, tantalum, vanadium, and molybdenum.

3. The vacuum micropump of claim 1, wherein the vacuum micropump is entirely disposed within the sealed package.

4. The vacuum micropump of claim 1, the anode comprising metal.

5. The vacuum micropump of claim 1, wherein the magnetic field is created by one or more of the group including permanent magnets, electro-magnets and superconductive magnets.

6. The vacuum micropump of claim 1, wherein the vacuum micropump operates continually as a getter within an encapsulated package.

7. The vacuum micropump of claim 1, wherein the current supplied by the electric field is measured to determine a pressure within the sealed package.

8. The vacuum micropump of claim 1, wherein the anode comprises one or more fins.

9. The vacuum micropump of claim 1, wherein the cathode comprises one or more fins.

10. The vacuum micropump of claim 1, wherein the anode is electrically insulated from the cathode by the dielectric.

11. The vacuum micropump of claim 1, wherein the magnetic field is substantially perpendicular to anode and cathode.

12. The vacuum micropump of claim 1, wherein the magnetic field is substantially aligned with the anode and cathode.

13. The vacuum micropump of claim 1, wherein the cathode and the anode are about equal in length.

14. The vacuum micropump of claim 1, wherein the micropump is not enclosed within a separate housing.

15. The vacuum micropump of claim 1, wherein the micro device is a MEMS device.

16. The vacuum micropump of claim 1, wherein the sealed package has a volume in the range of about 0.1 to 500 cubic millimeters.

17. A method of decreasing pressure within a sealed package enclosing a micro device; comprising:

providing at least one anode within the package and adjacent to the micro device;

providing at least one dielectric in contact with each anode within the package;

providing at least one fabricated metallic cathode, each cathode in contact with the dielectric, opposite from the anode, providing an open pumping cell adjacent to the micro device and within the sealed package, each dielectric further defining a space between each anode and cathode;

applying an electric field between each paired anode and cathode;

applying a magnetic field proximate to the space, the magnetic field promoting electrons to ionize gas molecules within the package, the ionized gas molecules sputtering metal from each cathode, the metal combining with other gas molecules and entrapping them.

18. The method of claim 17, wherein the metallic cathode comprises material selected from the group consisting of titanium, tantalum, vanadium, and molybdenum.

19. The method of claim 17, wherein the magnetic field is applied substantially transverse to the pumping cell.

20. The method of claim 17, wherein the magnetic field is applied substantially parallel to the pumping cell.

21. The method of claim 17, wherein a plurality of anodes, cathodes and dielectrics provide a plurality of pumping cells.

22. The method of claim 17, wherein the cathode and the anode are micro-fabricated to be about equal in length.

23. The method of claim 17, wherein the micropump is not enclosed within a separate housing.

24. The method of claim 17, wherein the sealed package has a volume in the range of about 0.1 to 500 cubic millimeters.

25. A vacuum micropump within a sealed package providing an encapsulated enviromnemt; comprising:

at least one micro device within the encapsulated environment of the sealed package;

at least one open pumping cell within the sealed package and adjacent to the micro device; each pumping cell including:

at least one anode;

at least one dielectric in contact with the at least one anode;

at least one cathode in contact with the dielectric and opposite from and aligned to the anode, the dielectric further defining a space between the at least one anode and the at least one cathode; and an electric field between the at least one anode and the at least one cathode; and a magnetic field proximate to the pumping cell.

26. The vacuum micropump of claim 25, wherein the cathode and the anode are about equal in length.

27. The vacuum micropump of claim 25, wherein the micro device is a MEMS device.

28. The vacuum micropump of claim 25, wherein the sealed package has a volume in the range of about 0.1 to 500 cubic millimeters.

* * * * *

UNITED STATES PATENT AND TRADEMARK OFFICE

CERTIFICATE OF CORRECTION

PATENT NO. : 7,413,412 B2
APPLICATION NO. : 10/878262
DATED : August 19, 2008
INVENTOR(S) : Alexander Govyandinov et al.

It is certified that error appears in the above-identified patent and that said Letters Patent is hereby corrected as shown below:

In column 4, line 10, delete “nicropump” and insert -- micropump --, therefor.

In column 10, line 38, in Claim 1, delete “oven” and insert -- open --, therefor.

In column 12, line 18, in Claim 25, delete “enviromnemt;” and insert -- environment; --, therefor.

Signed and Sealed this

Seventeenth Day of February, 2009

John Doll

JOHN DOLL
*Acting Director of the United States Patent and Trademark Office*